US006932140B2

(12) United States Patent
Ni

(10) Patent No.: US 6,932,140 B2
(45) Date of Patent: Aug. 23, 2005

(54) CORDLESS VENETIAN BLIND STRUCTURE

(76) Inventor: Leslie Ni, No. 45-4, Fan Po St., Fu Hsing Hsiang, Changhua Hsien (TW)

( * ) Notice: Subject to any disclaimer, the term of this patent is extended or adjusted under 35 U.S.C. 154(b) by 0 days.

(21) Appl. No.: 10/694,893

(22) Filed: Oct. 29, 2003

(65) Prior Publication Data

US 2005/0092446 A1 May 5, 2005

(51) Int. Cl.[7] ..... E06B 9/327
(52) U.S. Cl. ..... 160/172 R; 160/178.2 R
(58) Field of Search ..... 160/84.06, 178.2 R, 160/168.1 R, 173 R, 172 R, 170, 278, 243, 160/246; 16/199

(56) References Cited

U.S. PATENT DOCUMENTS 4,202,395 A * 5/1980 Heck et al. ..... 160/84.06
6,675,861 B2 * 1/2004 Palmer et al. ..... 160/170

* cited by examiner

*Primary Examiner*—Blair M. Johnson
(74) *Attorney, Agent, or Firm*—Troxell Law Office, PLLC

(57) ABSTRACT

A cordless Venetian blind structure includes a lower beam having a pair of clamps securely sealed at both ends thereof for a left and a right retaining cords to be held thereby before pivotally led through the bottom of the lower beam to be tied up to a windowsill for location thereon. A retaining unit and a control unit are mounted to the middle section of the lower beam respectively with the control unit limited by the retaining unit in pushing operation. A control cord pivotally led through the retaining unit and the control unit respectively at the middle section is attached to the clamps by both ends thereof. In operation, the control unit is pushed inwards to draw in the control cord by both ends and compress spring elements disposed at the clamps therein so as to release the retaining cords from the clamps for adjusting the Venetian blind up or down into a proper position. When the pushing force applied is removed, the clamps are bounced back, clamping tight the retaining cords thereof so as to relocate the Venetian blind at the proper position under the best using condition thereof. Moreover, a pair of coupling bodies can also be attached at both ends of the lower beam thereof with the same effect thereof.

6 Claims, 4 Drawing Sheets

CORDLESS VENETIAN BLIND STRUCTURE

BACKGROUND OF THE INVENTION

The present invention is related to a cordless Venetian blind structure, including a lower beam having a pair of clamps securely sealed at both ends thereof for a left and a right retaining cords to be held thereby before pivotally led through the bottom of the lower beam to be tied up to a windowsill for location thereon. A retaining unit and a control unit are mounted to the middle section of the lower beam respectively with the control unit limited by the retaining unit in pushing operation. A control cord pivotally led through the retaining unit and the control unit respectively at the middle section is attached to the clamps by both ends thereof. In operation, the control unit is pushed inwards to draw in the control cord by both ends and compress spring elements disposed at the clamps therein so as to release the retaining cords from the clamps for adjusting the Venetian blind up or down into a proper position. When the pushing force applied is removed, the clamps are bounced back in clamping engagement with the retaining cords thereof so as to relocate the Venetian blind at the proper position under the best using condition thereof.

A conventional Venetian blind is usually made up of a volute wheel unit in cooperation with pull cords and T-cords, which is not only tediously complex in assembly, but also quite dangerous to children in the household. When the Venetian blind is gathered up, pull cords are suspended downwards for a certain length outside the blind thereof. Children playing around the blind may easily get caught by the suspending pull cords. In case the blind is careless unfolded, the withdrawing pull cords might hurt or even strangle the children got caught in them. Thus, the conventional Venetian blind poses a potential danger to children in the household.

SUMMARY OF THE PRESENT INVENTION

It is, therefore, the primary purpose of the present invention to provide a cordless Venetian blind structure, including a lower beam having two clamps securely joined at both ends thereof in working with a control cord, a control unit, and a retaining unit wherein the control cord led through the control unit and the retaining unit respectively by the middle section is attached to the clamps by both ends; whereby, the control unit limited by the retaining unit and mounted to the middle section of the lower beam is pushed inwards to draw in both ends of the control cord and compress spring elements of the clamps so as to release left/right retaining cords fixedly held by the clamps therein for adjusting the Venetian blind up or down into a proper position. When the pushing force applied is removed, the clamps are bounced back to clamp tight the left/right retaining so as to relocate the Venetian blind at the proper position, facilitating the best using condition thereof.

It is, therefore, the secondary purpose of the present invention to provide a cordless Venetian blind structure wherein the left/right retaining cords securely fixed by the clamps thereof are led straight downwards and passed through cord passages holes disposed at the bottom of the lower beam to be tied up to a windowsill, providing a cordless Venetian blind structure for the safety of children in the household.

It is, therefore, the third purpose of the present invention to provide a non-pull cord operable Venetian blind wherein, via two clamps in working with the control cord, the retaining unit, and the control unit, the Venetian blind thereof is easily and precisely gathered up or unfolded without any other volute wheel unit, pull cords, or T-cords applied thereon, economically reducing the parts of assembly and the costs of materials as well as facilitating the assembly of the present invention in an easy and fast manner.

DETAILED DESCRIPTION OF THE PREFERRED EMBODIMENTS

Figure 1:
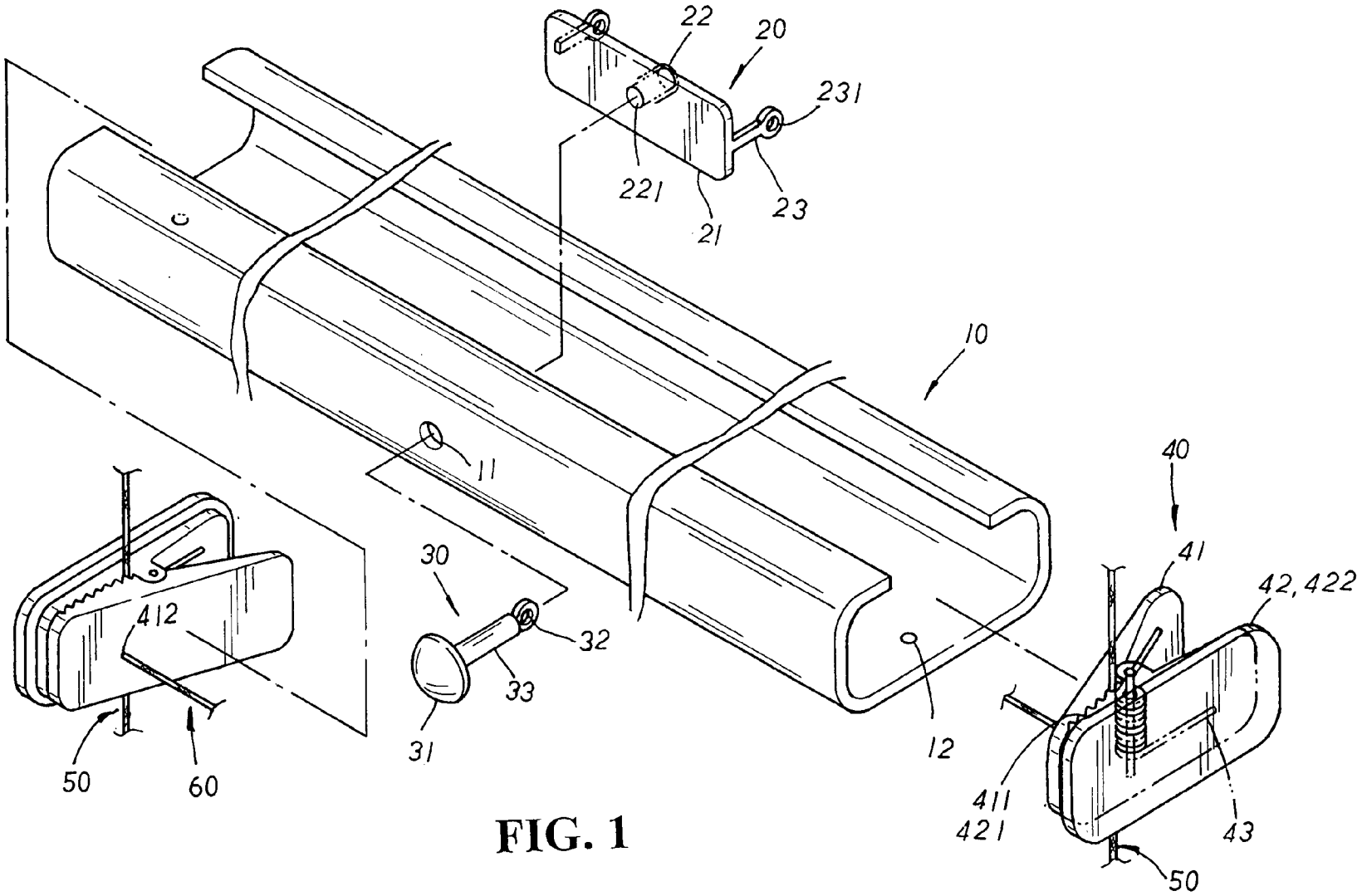
FIG. 1 is a perspective exploded view of the present invention.

Please refer to FIG. 1. The present invention is related to a cordless Venetian blind, comprising a lower beam 10, a retaining unit 20, a control unit 30, and two clamps 40. The lower beam 10 has a central through hole 11 disposed at the front side thereof, and a cord passage hole 12 disposed at the bottom side of each end thereof respectively. The retaining unit 20 is made up of an abutting board 21 disposed at the front side thereof, a protruded rod 22 with a central passage 221 defined therein disposed at the rear side thereof, and a pair of extending plates 23 each having a cord hole 231 disposed thereon protruding at the rear side of both ends thereof. The control unit 30 is equipped with a push head 31 protruding at one end thereof, a pivot hole 32 disposed at the other end thereof, and an insertion rod 33 disposed at the middle section thereof. The clamp 40 is made up of a movable plate 41 and a fixed plate 42 bound by a spring element 43 attached at the movable plate 41 and the fixed plate 42 there-between. A serrated retaining section 411 and a serrated fixing section 421 are disposed at the corresponding inner side of the movable plate 41 and the fixed plate 42 thereof respectively, clamping tight in mutual engagement via the spring element 43 for holding a left/right retaining cord 50 therein. The fixed plate 42 of the clamp 40 also has a closed facet 422 disposed at the outer surface thereof, and the movable plate 41 thereof has a retaining hole 412 preset at the serrated retaining section 411 thereon for a control cord 60 to be led there-through and fixed to the movable plate 41 thereby.

Figure 2:
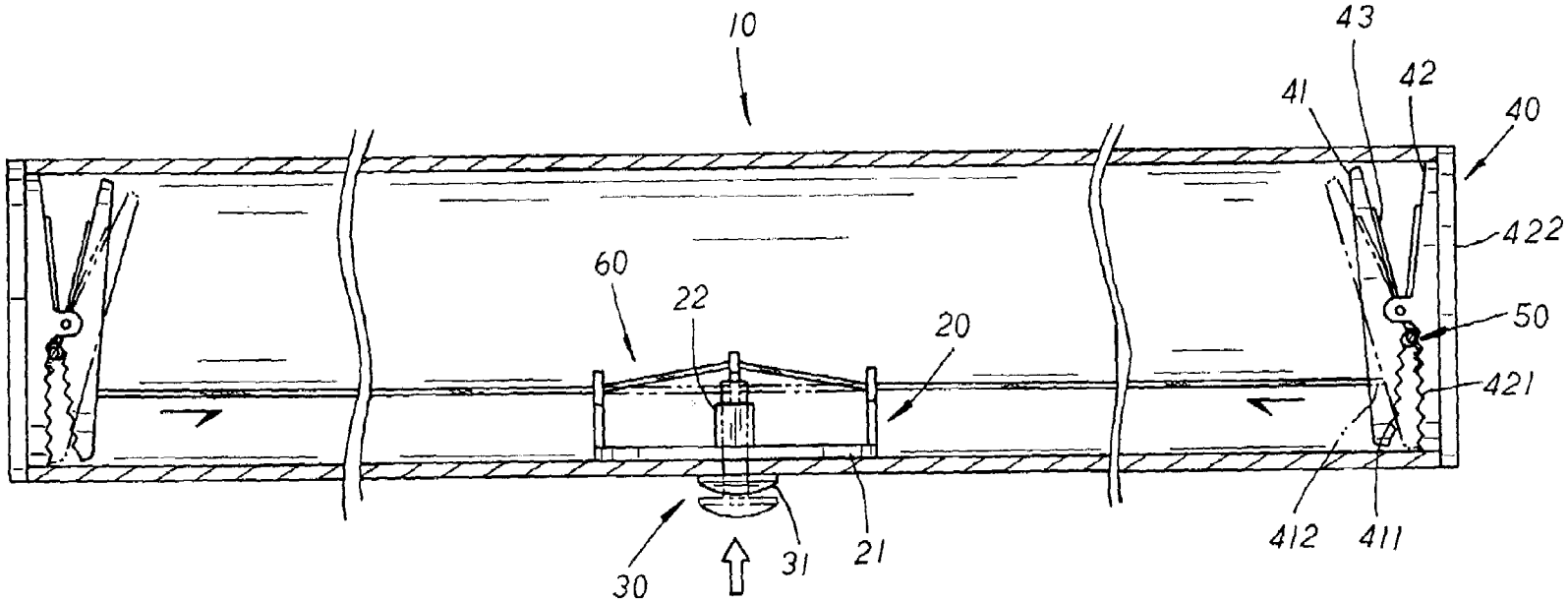
FIG. 2 is a sectional top view of the present invention in operation.
Figure 3:
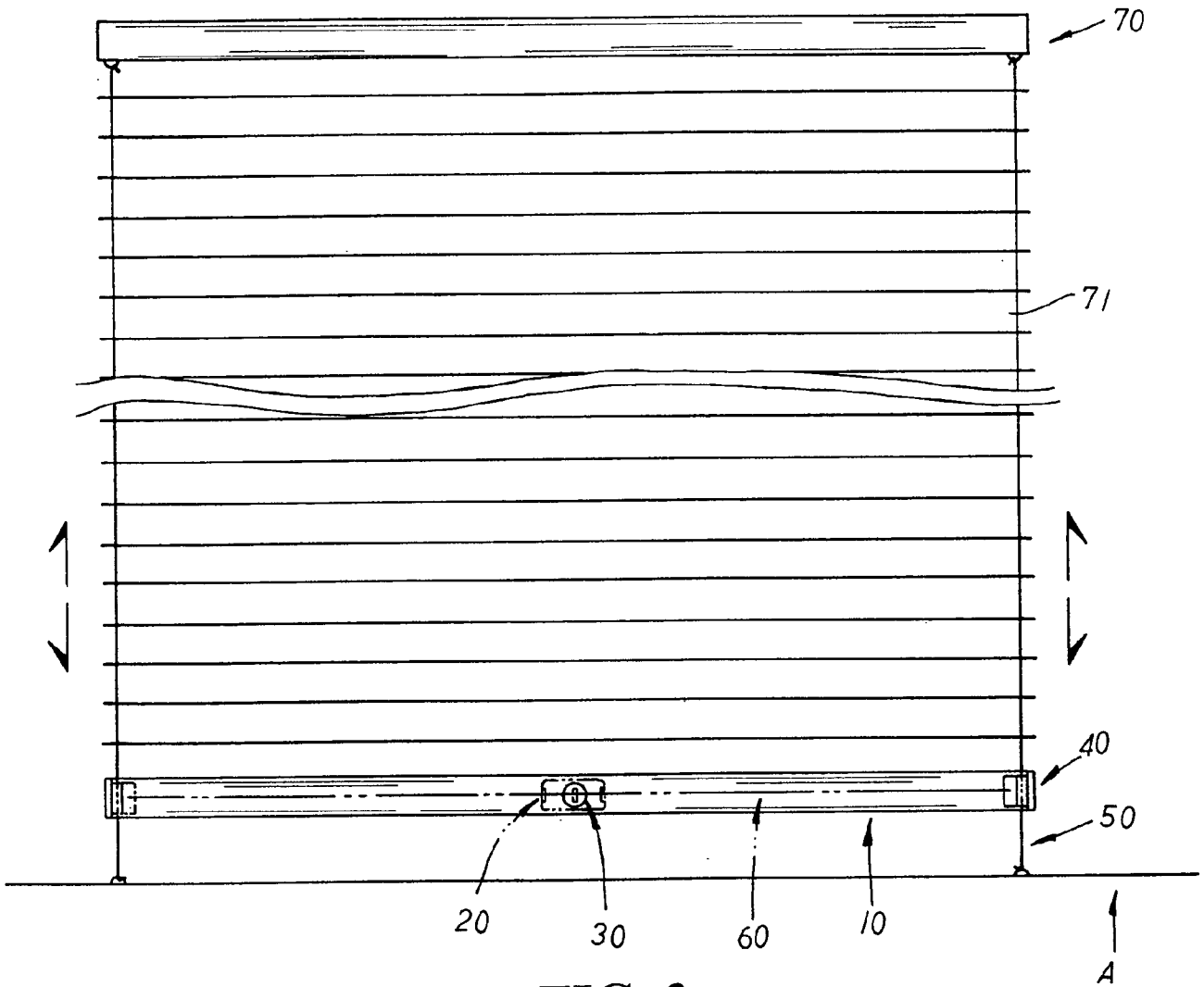
FIG. 3 is a diagram showing a blind body of the present invention pushed upwards or drawn downwards in practical use.

Please refer to FIGS. 2, 3. In assembly, the retaining unit 20 is led from top to bottom to be abutted against the inner side of the lower beam 10 via the abutting board 21 thereof with the central passage 221 of the protruded rod 22 thereof correspondingly matched to the central through hole 11 of the lower beam 10. The control unit 30 is led through the central through hole 11 of the lower beam 10 and the central passage 221 of the protruded rod 22 thereof till the pivot hole 32 thereof extending outwards at the other end of the protruded rod 22 thereof and the insertion rod 33 thereof pivotally movable at the central passage 221 of the protruded rod therein. One end of the control cord 60 is led through the retaining hole 412 of the movable plate 41 and securely attached to the serrated retaining section 411 of the movable plate 41 thereon before the clamp 40 is joined to one end of the lower beam 10 with the closed facet 422 securely stopped at the outer end of the lower beam 10 in sealing engagement. The other end of the control cord 60 is sequentially passed through the cord holes 231 of the retaining unit 20 and the pivot hole 32 of the control unit 30 thereof respectively before led through the retaining hole 412 of another movable plate 41 and securely attached to the serrated retaining section 411 of the clamp 40 sealed at the other end of the lower beam 10 via the closed facet 422 thereof.

With the control cord 60 attached at both corresponding inner sides thereof, the clamps 40 are securely engaged with the lower beam 10 with the closed facets 422 thereof closely sealed at the outer side of both ends of the lower beam 10 thereof. Meanwhile, the control cord 60 is tensely stretched into a straight line at the lower beam 10 therein. The left and right retaining cords 50 attached to an upper beam 70 are then led vertically downwards, each passing through the clamp 40 to be fixedly held between the serrated retaining section 411 and the serrated fixing section 421 of the movable plate 41 and the fixed plate 42 thereof in clamping location. The bottom end of the left/right retaining cords 50 is pivotally passed through the cord passage holes 12 of the lower beam 10 and straightly tied up to a windowsill A as shown in FIG. 3 so as to keep the safety of children in the household. Thus, children can avoid the danger of getting caught by the retaining cords 50 thereof while playing around nearby.

In practical use, the push head 31 of the control unit 30 is pressed towards the inner side of the lower beam 10, moving inwards the pivot hole 32 of the control unit 30 thereof, and drawing in the control cord 60 by the middle section therewith. Limited by the cord holes 231 of the retaining unit 20 thereof, the straightly stretched control cord 60 is bent into an angle by the middle section, forming a pulling force to draw in the clamps 40 from both sides thereof. With the fixed plates 42 thereof securely sealed at the both ends of the lower beam 10 via the closed facets 422 thereof, the movable plates 41 of the clamps 40 are drawn inwards by the leverage of the control cord 60, compressing the spring element 43 to release the left/right retaining cord 50 from the clamping location of the serrated retaining section 411 and the serrated fixing section 421 thereof. Via the guidance of the left and right retaining cords 50, a blind body 71 can be adjusted into a proper position by either pushed upwards or drawn downwards. When the pushing force applied is removed, the clamps 40 are bounced back to clamp tight the left/right retaining cords 50 thereof so as to relocate the blind body 71 at the proper position under the best using condition thereof.

Figure 4:
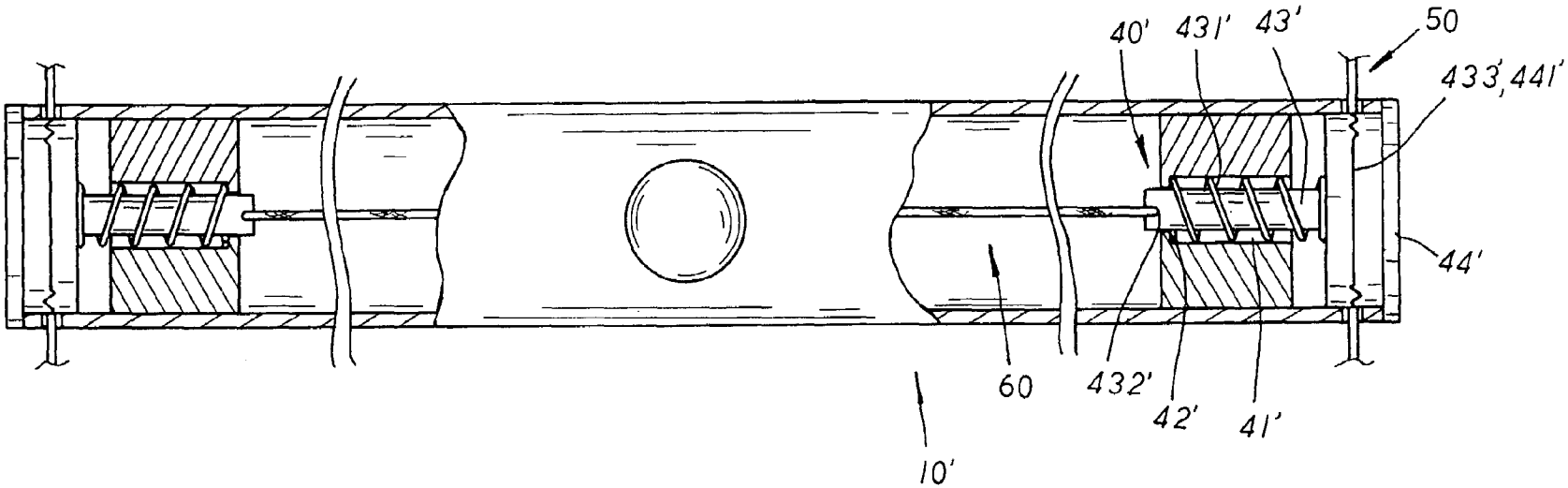
FIG. 4 is a cross sectional view of another embodiment of the present invention.

Please refer to FIG. 4. The present invention can also have a lower beam 10', and a coupling body 40' attached at both ends of the lower beam 10' thereof respectively. The coupling body 40' is made up of a central through hole 41' and a stop flange 42' disposed at the inner side of the central through hole 41' for a movable unit 43' having a spring element 431' disposed thereon to be led and abutted thereby. The movable unit 43' has a cord hole 432' disposed at one side thereof for the control cord 60 to be attached thereto by both ends thereof, and a serrated retaining section 433' protruding at the other side of the movable unit 43' thereof. A pair of sealing covers 44' are disposed at both ends of the lower beams 10' thereof, each having a serrated fixing section 441' disposed at one side thereof correspondingly matched to the serrated retaining section 433' of the movable unit 43' in clamping engagement for holding the retaining cord 50 therein. When the control unit 30 is pressed inwards at the lower beam 10' thereof, the control cord 60 will collect in from both sides, drawing in the movable units 43' therewith and compressing the spring element 431' thereof to release the left/right retaining cords 50 from the clamping location of the serrated retaining section 433' and the serrated fixing section 441' thereof. Thus, the blind body 71 is adjusted upwards or downwards via the guidance of the retaining cords 50 thereof. The pressing force applied is removed to bounce back the serrated retaining section 433' and the serrated fixing section 441', clamping tight the left/right retaining cords 50 so as to relocate the blind body 71 at a proper position thereof.

What is claimed is:

1. A cordless Venetian blind structure comprising:

a lower beam having a pair of clamps securely sealed at two ends thereof, each of the pair of clamps selectively engaging one of a left and a right retaining cord inserted through a bottom of the lower beam to be connected to a windowsill;

a retaining unit and a control unit mounted to a middle section of the lower beam, the control unit controlling the retaining unit; and a control cord inserted through the retaining unit and the control unit and connected at opposing ends thereof to an inner side of each of the pair of clamps;

wherein, in operation, when the control unit is pushed inwards to draw in both ends of the control cord and compress spring elements located in each of the pair of clamps moving the pair of clamps to an open position such that the pair of clamps release the left and right retaining cords for adjusting the Venetian blind up and down to a predetermined position; when a pushing force is removed, the clamps move to a closed position, clamping tight the retaining cords such that the Venetian blind is held at a predetermined position.

2. The cordless Venetian blind structure as claimed in claim 1, wherein the lower beam has a central through hole located in a front thereof, and a cord passage hole located in the bottom of each of the two ends thereof.

3. The cordless Venetian blind structure as claimed in claim 1, wherein the retaining unit is made up of an abutting board located on a front thereof, a protruded rod with a central passage defined therein extending from a rear thereof, and a pair of extending plates each having a cord hole extending from opposing ends of the rear thereof.

4. The cordless Venetian blind structure as claimed in claim 1, wherein the control unit is equipped with a push head protruding at one end thereof, a pivot hole disposed at the other end thereof, and an insertion rod disposed at the middle section thereof.

5. The cordless Venetian blind structure as claimed in claim 1, wherein each of the pair of clamps has a movable plate and a fixed plate bound by the compress spring element attached between the movable plate and the fixed plate; a serrated retaining section and a serrated fixing section are located on a corresponding inner side of the movable plate and the fixed plate thereof respectively, clamping tight in mutual engagement via the spring element thereof; the fixed plate has a closed facet located on an outer surface thereof, and the movable plate thereof has a retaining hole located in the serrated retaining section and having the control cord inserted therein and attached to the movable plate.

6. The cordless Venetian blind structure as claimed in claim 1, wherein the coupling body includes a central through hole and a stop flange disposed at an inner side of the central though hole; a movable unit having a spring element inserted into the central through hole, the spring element engaging the stop flange; the movable unit has a cord hole located on a first end with the control cord attached thereto, and a serrated retaining section protruding from a second end of the movable unit; a pair of sealing covers located on each of the two ends of the lower beam, each of the pair of sealing covers having a serrated fixing section located on one side thereof correspondingly matching the serrated retaining section of the movable unit in clamping engagement for holding one of the left and right retaining cords therein.

* * * * *